United States Patent [19]

Delgado et al.

[11] Patent Number: 5,072,795

[45] Date of Patent: Dec. 17, 1991

[54] PRESSURE COMPENSATOR FOR DRILL BIT LUBRICATION SYSTEM

[75] Inventors: Steve R. Delgado, Houston; Robert J. Kotch, Kingwood; Frank Hall, Houston, all of Tex.

[73] Assignee: Camco International Inc.

[21] Appl. No.: 643,486

[22] Filed: Jan. 22, 1991

[51] Int. Cl.[5] ..... E21B 10/22

[52] U.S. Cl. ..... 175/228; 175/371; 384/93

[58] Field of Search ..... 175/228, 227, 371, 372, 175/229; 384/93

[56] References Cited

U.S. PATENT DOCUMENTS

| | | | |
|---|---|---|---|
| 3,476,195 | 11/1969 | Galle | 175/228 |
| 3,847,234 | 11/1974 | Schumacher, Jr. et al. | 175/228 |
| 3,942,596 | 3/1976 | Millsapps, Jr. | 175/227 |
| 4,055,225 | 10/1977 | Millsapps | 175/228 |
| 4,161,223 | 7/1979 | Oelke | 175/228 |
| 4,597,455 | 9/1986 | Walters et al. | 175/228 |
| 4,727,942 | 3/1988 | Galle et al. | 175/228 |
| 4,887,675 | 12/1989 | Shotwell | 175/228 |

FOREIGN PATENT DOCUMENTS

| | | | |
|---|---|---|---|
| 1303695 | 4/1987 | U.S.S.R. | 175/227 |

*Primary Examiner*—Hoang C. Dang

*Attorney, Agent, or Firm*—Dodge, Bush, Moseley & Riddle

[57] ABSTRACT

A fluid pressure compensator for a lubrication system in a rotary drill bit includes a diaphragm (44) with an enlarged thickness central portion (62) having a generally hemispherically shaped deformation (72) at its center to form a minimal thickness thereat progressively increasing to the enlarged thickness. A self sealing puncture (74) is provided at the center of the diaphragm (44) to relieve excess pressure differentials in the lubrication system internally of the drill bit and excess pressure differentials in the drilling fluid externally of the drill bit. The diaphragm (44) has an enlarged protuberance (64) about its outer periphery which is secured in sealing relation within a groove formed by sealing surfaces (66, 68, 70) on a leg (10) of the rotary bit and associated securing cap (46). A protective cup (42) supports the diaphragm (44) in an extended position and has dimples (58) for supporting the diaphragm (46) on the bottom (40) of the lubricant reservoir (49).

11 Claims, 3 Drawing Sheets

FIG.1
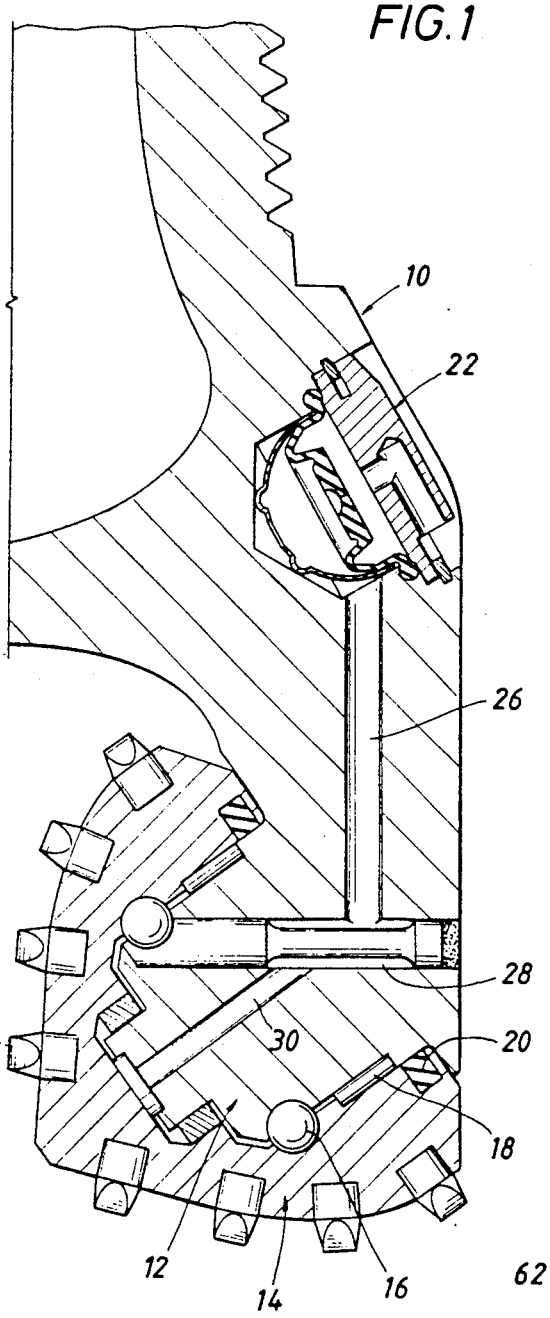
FIG.4
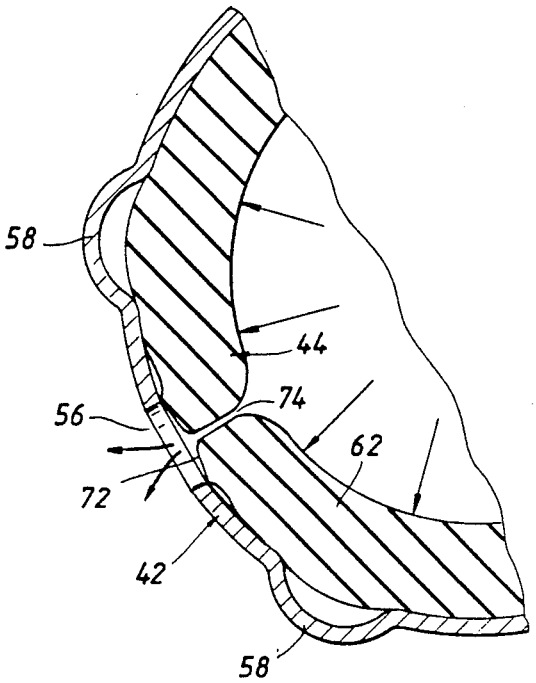
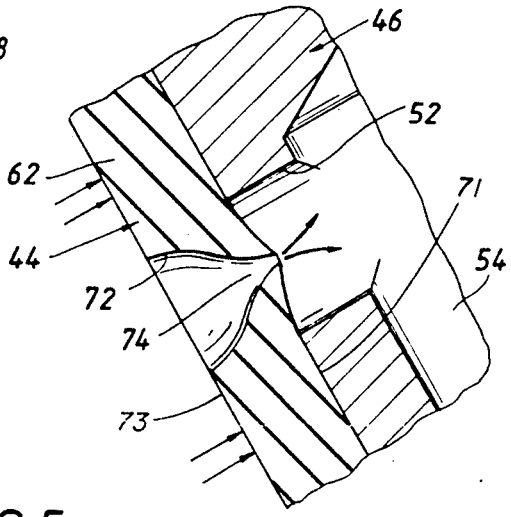
FIG.5

FIG. 2
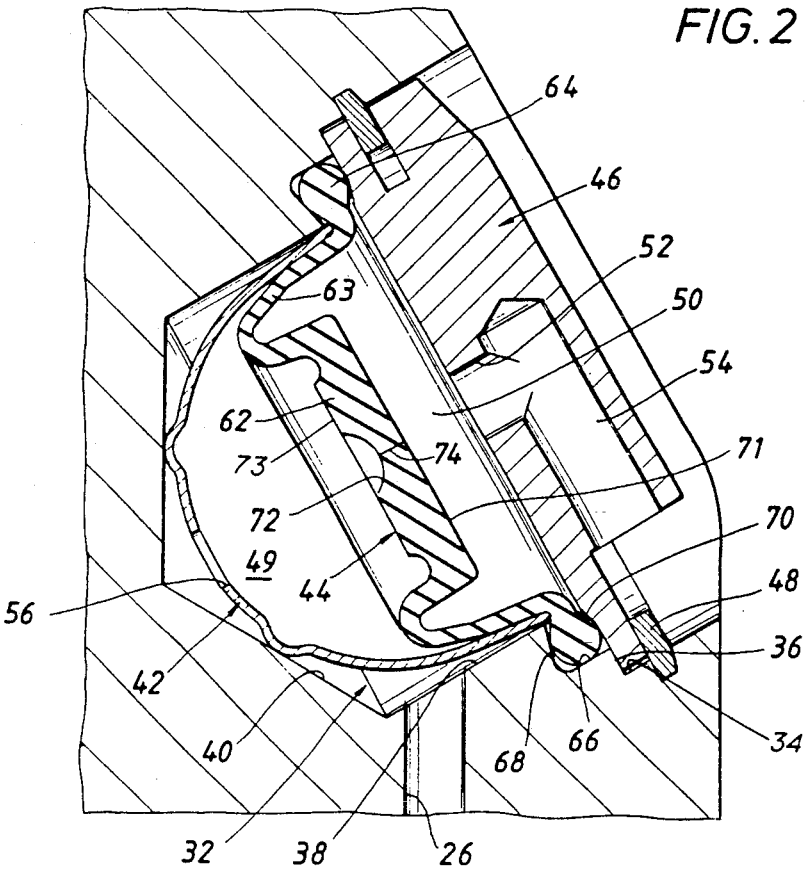
FIG. 3
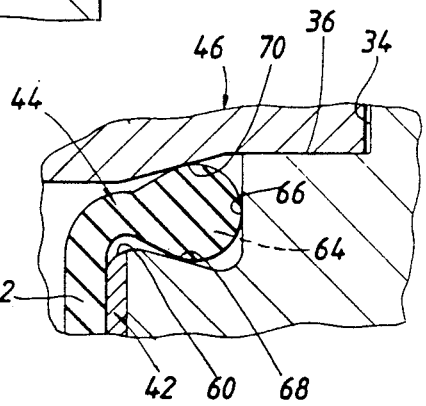
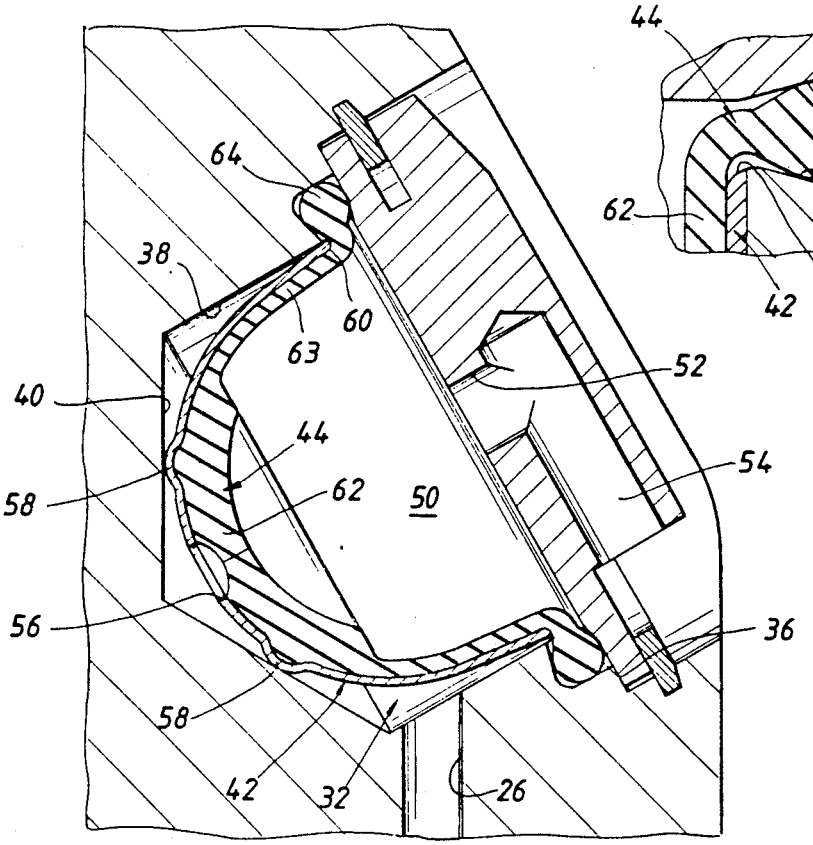
FIG. 2A

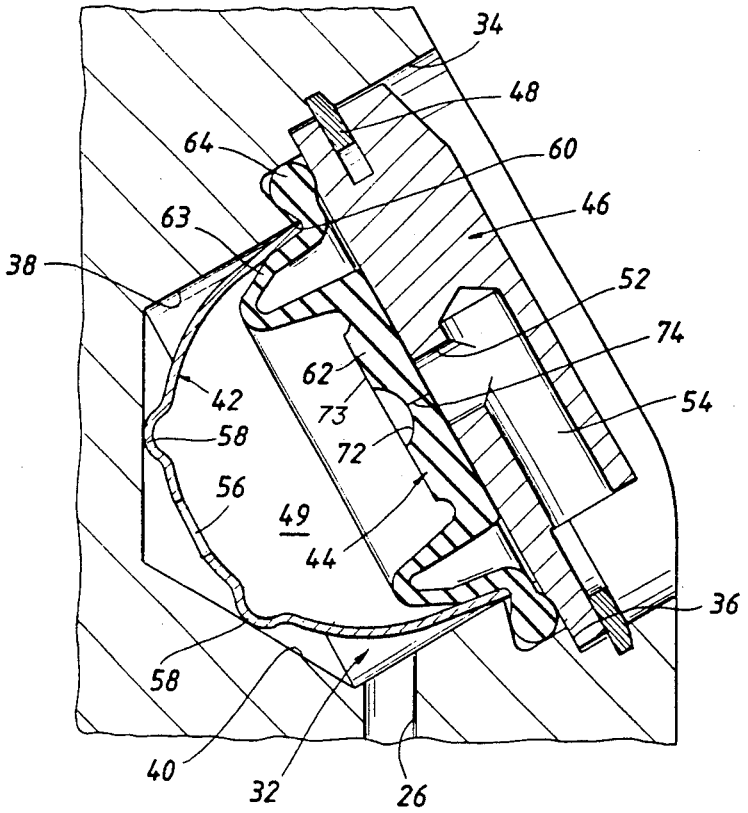
FIG. 2B
FIG. 6
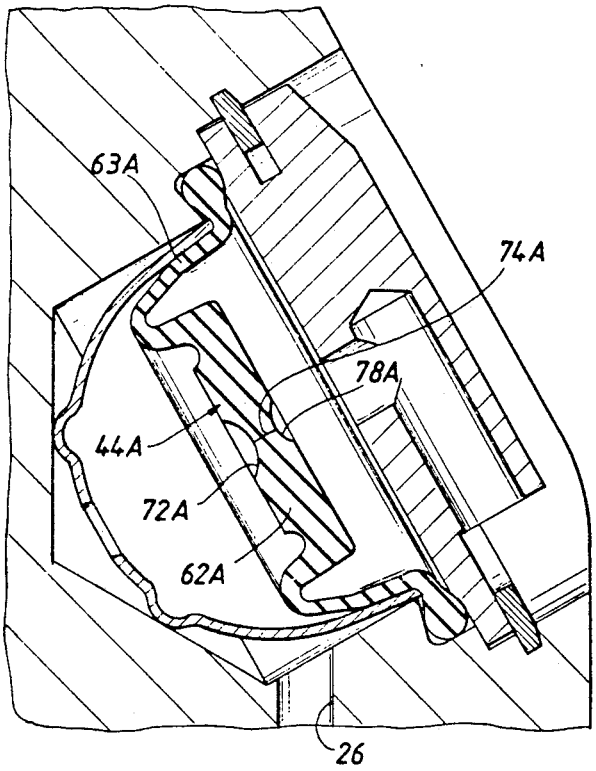
FIG. 7
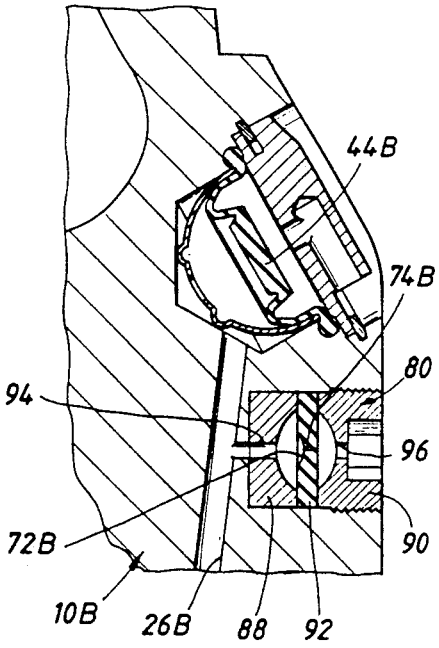

PRESSURE COMPENSATOR FOR DRILL BIT LUBRICATION SYSTEM

BACKGROUND OF INVENTION

This invention relates generally to sealed roller cutter drill bits for drilling oil and gas wells, and more particularly to improvements in the lubrication system for sealed roller cutter drill bits.

The lubrication system for such roller cutter drill bits normally includes an elastomeric compensating diaphragm which serves to balance the hydrostatic drilling fluid or mud pressure outside the bits to the lubricant pressure within the bit and to minimize pressure differential pulses across the seal caused by axial motion or wobbling of the rotating rolling cutter on a journal while maintaining a leak proof barrier between the mud region outside the bit and lubricant within the bit. It is desirable to maintain this leak proof barrier until a predetermined pressure differential occurs which might cause damage to the rotary seal which seals the lubricant within the bearing system. In order to limit this differential pressure, a pressure relief valve is normally provided in the lubrication system to relieve an excessive or damaging pressure differential incurred across the seal in the event the diaphragm bottoms out in the lubricant reservoir or otherwise has its movement restricted.

The simplest and most economical method of providing a pressure relief valve is to make it as an integral part of the elastomeric diaphragm. This was accomplished in a design of a pressure relieving device disclosed by P. W. Schumacher, Jr. and Henry W. Murdoch in U.S. Pat. No. 3,847,234 dated Nov. 12, 1974 which relieved excessive lubricant differential in one direction as well as excessive drilling fluid pressure differential in an opposed direction to provide a so-called two way relief valve. A later design by Edward M. Galle and Anton F. Zahradnik in U.S. Pat. No. 4,727,942 dated Mar. 1, 1988 provided a so-called one way relief valve in which only excessive lubricant pressure differential is relieved.

Thus, the diaphragm of the lubrication system in U.S. Pat. No. 3,847,234 discloses a two way relief valve in the diaphragm which relieves damaging differential pressures both when the lubricant pressure is higher than the drilling mud pressure and when the drilling mud pressure is higher than the lubricant pressure. The diaphragm of the lubrication system in U.S. Pat. No. 4,727,942 discloses a one way valve in the diaphragm which relieves damaging differential pressure only when the lubricant pressure is higher than the mud pressure.

The elastomeric compensating diaphragm must be secured in the lubricant reservoir cavity in a fluid tight sealed relation. The simplest and most reliable method of doing this is to clamp an enlarged periphery of the diaphragm against a reservoir cavity counterbore to form a seal and hold the enlarged outer periphery of the diaphragm captive. U.S. Pat. No. 4,055,225 discloses a method to do this by clamping the diaphragm and a protector cup flange together against the reservoir cavity counterbore. However vibration of the cup during drilling could cause the seal to leak.

SUMMARY OF THE INVENTION

The present invention provides a lubrication system for a sealed roller cutter drill bit having an elastomeric member with an improved two way normally closed relief valve or vent. In a preferred embodiment the relief valve is an integral part of the elastomeric diaphragm which is located in a lubricant reservoir. The elastomeric diaphragm has a central portion of a large thickness formed with a conically or hemispherically shaped deformation or indentation to provide a flexible minimum thickness section at the center of the deformation which progressively increases in thickness from the center to the large thickness central portion. The minimum thickness section has a puncture or slit therethrough which forms a two way relief valve that protects the lubricant seal from damaging differential pressures both when the lubricant pressure is higher than the drilling mud pressure and when the drilling mud pressure is higher than the lubricant pressure. The improvement includes the conical or hemispherically shaped depressed central area of the diaphragm which increases progressively in thickness from the puncture at the minimum thickness center and this reduces the tendency of the puncture or slit to enlarge during operation of the bit which would decrease the relieving pressures and possibly cause leaking of drilling fluid past the diaphragm into the bearing areas of the roller cutter or loss of lubricant, both of which would tend to reduce the effective life of the bit.

The elastomeric diaphragm or boot has a so-called rolling annular loop adjacent its outer periphery which permits axial movement of the diaphragm to an extended position either toward the mud end of the reservoir or toward the lubricant end of the reservoir. The annular loop is designed to cause the enlarged inner portion with the two way relief valve to remain centered as the diaphragm extends in either direction. A separate supporting protector cup is mounted adjacent the bottom wall of the lubricant reservoir to support the diaphragm at its fully extended position toward the lubricant end of the reservoir to prevent overextension and possible damage to the diaphragm. A central opening or aperture is provided in the protector cup to permit flow of lubricant from the lubricant chamber into the bearing area. In the event the diaphragm becomes fully extended into the cup and a high differential pressure occurs a small amount of drilling fluid would be released through this opening into the lubricant area. The size of this opening can help determine this predetermined relieving pressure. The supporting cup does not have an upper annular flange and is not received within a groove but is simply fitted within the reservoir with the diaphragm resting against the inner surface of the cup when extended toward the lubricant end of the reservoir. Thus, any vibration or movement of the cup has no effect upon the sealing of the diaphragm about its outer periphery.

A cap is positioned within the open outer end of the reservoir for tightly clamping an outer enlarged portion of the diaphragm directly against an annular shoulder or abutment about the reservoir. The diaphragm has an outer annular bead or enlargement about its outer periphery which is received within a diverging pocket or groove between the cap and the annular shoulder for securement therein. Three normally separated sealing contacts or points are provided between the surface of the diverging pocket and the enlarged bead on the outer periphery of the diaphragm.

The lubricant reservoir has an opening at one end to the drilling mud area and an opening at the other end to the lubricant area. If the diaphragm with the puncture forming a two way relief valve bottoms out against the cap at the drilling mud end of the reservoir causing the lubricant pressure to be higher than drilling mud pressure, lubricant is released by the puncture into the drilling mud area at a predetermined differential pressure thus protecting the seal from damaging differential pressures. This can occur when the lubricant expands from heat or when outgassing of the grease occurs.

If the diaphragm bottoms out against the protector cup at the lubricant end of the reservoir causing drilling mud pressure to be higher than lubricant pressure, a small amount of drilling mud enters the lubricant chamber at a predetermined differential pressure and this also protects the seal from damaging differential pressures. This can occur if the reservoir is not large enough to handle compression of the lubricant in the system caused by the hydrostatic pressure outside the bit. This is possible if gas such as air is trapped in the lubricant system. The diaphragm also bottoms out against the protector cup at the lubricant end of the reservoir when all of the lubricant is either pumped or leaks out of the seal. The normally closed two way relief valve or vent thus provides relief at a predetermined relatively high differential pressure to protect the seal from damage.

The venting or relief of differential pressures by the puncture in the diaphragm should be at values or amounts to protect the seal from damage from a transient pressure differential surge. This venting pressure may vary between 50 psi to 500 psi and still perform the function of protecting the seal from damage. Preferably lubricant would be relieved at a differential pressure of 75–150 psi while drilling fluids would be relieved at a differential pressure of 200–400 psi. It is preferable to have a relatively large differential pressure for relieving drilling fluids since it is desired that only a small amount of drilling fluid leaks into the lubricant. If too much drilling fluid leaks into the lubricant and bearing system, damaging bearing wear can occur.

It is an object of this invention to provide an improved fluid pressure compensator for the lubrication system in a sealed roller cutter drill bit having a vent within the diaphragm which relieves excessive pressure differentials both when the lubricant pressure is higher than the drilling mud pressure and when the drilling mud pressure is higher than the lubricant pressure with the diaphragm resisting splitting or tearing at the vent.

It is a further object of this invention to provide such a pressure compensator in which a diaphragm in the lubricant reservoir has improved sealing about its outer periphery.

An additional object is to provide such a pressure compensator in which a protective cup in the lubricant reservoir supports the diaphragm in an extended position allowing communication between the reservoir and the lubricant passages and is mounted in such a manner as to not affect the sealing about the outer periphery of the diaphragm.

Another object is to provide a fluid pressure compensator having a diaphragm with a self centering rolling annular loop.

Other objects, features, and advantages of the invention will be apparent after referring to the following specifications and drawings.

BRIEF DESCRIPTION OF THE DRAWINGS

FIG. 1 is a vertical sectional view through one leg of a rotary drill bit and showing a conical roller cutter mounted on a bearing journal of the leg for rotation with the improved pressure compensator of the present invention;

FIG. 2 is an enlarged fragment of FIG. 1 showing the pressure compensator for the lubrication system including a diaphragm in an intermediate position secured by a cap in a receiving groove;

FIG. 2A is a view similar to FIG. 2 but showing the diaphragm extended against a protective cup from the compression of or loss of lubricant from the bearing system;

FIG. 2B is a view similar to FIG. 2 but showing the diaphragm extended against an outer cap due to expansion of the lubricant from heat;

FIG. 3 is an enlarged section of the receiving groove for the protuberance on the outer periphery of the diaphragm illustrating the diaphragm gripped in sealing relation between opposed tapering surfaces on the cap and the leg;

FIG. 4 is an enlarged section of a portion of the diaphragm and protective cup illustrating the leakage of drilling fluid through the puncture in the diaphragm and through an aligned aperture in the protective cup into the lubricant reservoir;

FIG. 5 is an enlarged section of a portion of the diaphragm and adjacent cap showing the leakage of lubricant through the puncture in the diaphragm and through an aligned central hole in the cap upon a high lubricant differential pressure;

FIG. 6 is a sectional view of another embodiment of the pressure compensator for a drill bit lubrication system in which the center of the diaphragm has a reduced thickness and a defomation is provided on both sides of the diaphragm at the reduced thickness center; and FIG. 7 is a sectional view of a further modification of the present invention in which a separate pressure relief device spaced from the main diaphragm is provided.

DESCRIPTION OF THE INVENTION

Referring now to the drawings for a better understanding of this invention, and more particularly to the embodiment shown in FIGS. 1–5, a leg is generally indicated at 10 for rotary drill bit. Three generally identical legs 10 are welded to each other to form the rotary drill bit with each leg comprising one third of the bit body. Leg 10 has a bearing journal generally indicated at 12 extending inwardly from its lower extending end and a conical roller cutter generally indicated at 14 is mounted for rotation on bearing journal 12. Ball bearings 16 retain roller cutter 14 on bearing journal 12 for rotation and suitable bearings 18 are provided between bearing surfaces of roller cutter 14 and bearing journal 12. A resilient seal 20 between journal 12 and roller cutter 14 separates the bearing areas of roller cutter 14 from the external drilling fluid.

A lubrication system is provided for lubricating the bearing areas between roller cutter 14 and journal 12 and includes a lubricant supply and pressure compensating means shown generally at 22 for supplying lubricant through lubricant passages 26, 28, and 30 to the bearing areas. The pressure compensating means is provided for equalizing fluid pressure on opposite sides of resilient seal 20 so that drilling fluid and entrained foreign matter are not forced into the bearing areas thereby to retain lubricant in the bearing areas when the drill bit is in use. A bore in leg 10 defines an inner small diameter bore portion 32 and an enlarged diameter outer bore portion 34 separated by an annular shoulder 36. Small diameter bore portion 32 forms a cylindrical wall 38 and a tapered bottom 40.

A protective cup shown generally at 42 is supported on tapered bottom 40 and a pressure compensating diaphragm shown generally at 44 extends across small diameter bore portion 32. A cap indicated generally at 46 is secured by a split ring 48 within a slot in enlarged bore portion 34 for retaining diaphragm 44 in position. A lubricant reservoir or lubricant chamber 49 is formed on one side of diaphragm 44 and a drilling fluid chamber 50 is provided on the opposed opposite side of diaphragm 44. Cap 46 has a central hole 52 therein and a laterally extending drilling fluid passage 54 communicates with central hole 52 to provide a drilling fluid passage to drilling fluid chamber 50 to exposed diaphragm 44 to drilling fluid on one side thereof.

Protective support cup 42 is generally bowl shaped and has a central aperture 56 at its bottom in axial alignment with central hole 52. A plurality of dimples or bowl shaped deformations 58 are spaced along a circular path on the bottom of cup 42 adjacent aperture 56. Three or four dimples 58 may be arranged along the circular path for supporting cup 42 on tapered bottom 40. Lubricant can flow between dimples 58 during the back and forth movement of diaphragm 44. Cup 42 is rounded at upper end 60 to prevent possible cutting of diaphragm 44 upon contact with end 60.

Diaphragm 44 comprises an important part of this invention and includes a center portion indicated at 62 of a relatively thick cross section, and an integrally connected rolling loop 63 of a lesser thickness terminating at an integral outer protuberance or bead 64 of an enlarged cross section about the outer periphery of diaphragm 44. Referring to FIG. 3, the outwardly diverging groove or pocket to receive protuberance 64 in sealing relation is illustrated. The groove or pocket is formed by an outer peripheral surface 66 of leg 10 adjacent shoulder 36, an inner shoulder 68 in stepped relation to shoulder 36 and tapering inwardly from outer peripheral surface 66, and an outer gripping or compressing annular surface or shoulder 70 on cap 46 in spaced opposed relation to inner shoulder 68 and tapering inwardly from peripheral surface 66 to provide a relatively narrow throat leading to the groove. Normally, sealing is provided at three separate areas between protuberance 64 and adjacent surfaces 66, 68, and 70 defining the receiving groove. Under certain conditions of operation, a high drilling fluid pressure differential might break the seal along surface 70, and a high lubricant fluid pressure differential might break the seal along surface 68. However, at least two of the sealing areas at 66, 68, and 70 are maintained under all conditions of operation as a high differential pressure on either side of the diaphragm 44 further energizes the sealing relation at the remaining two remote sealing surfaces.

Central portion 62 of diaphragm 44 has a normally planar face 71 on the mud side and a normally planar face 73 on the lubricant side. A generally hemispherical or conically shaped deformation or indentation 72 is formed in face 73 at the center of the lubricant side. Indentation 72 has a diameter preferably around ¼ inch but may vary between around ⅛ and ½ inch and function satisfactory under certain conditions. A self sealing normally closed puncture 74 is formed by a needle or a similar instrument at the center of deformation 72 at the minimum thickness of diaphragm 44. The thickness of diaphragm 44 progressively increases from puncture 74 to the maximum thickness of portion 62 thereby to minimize any tearing or slitting of diaphragm 44 at puncture 74 to enlarge puncture 74 for opening at undesired pressure differentials. Puncture 74 under normal operation without any substantial fluid pressure differential remains in a closed sealed position.

As shown in FIG. 4, diaphragm 44 is extended because for example too much air may be trapped in the lubrication system and hydrostatic compression exerted outside the bit causes the lubricant to compress and diaphragm 44 to bottom out against cup 42. This causes a high drilling fluid differential pressure against the inner surface of protective cup 42 with the result that at a predetermined differential pressure, drilling fluid leaks through open puncture 74 and aperture 56 into lubricant reservoir 49 to prevent any damaging differential pressure from occurring and acting against seal 20 internally of cutter 14. Upon a reduction in the pressure differential, puncture 74 self seals to restrict any additional leakage of drilling fluid into the lubricant reservoir 49.

As shown in FIG. 5, diaphragm 44 is shown in an extended position with the planar outer face 71 of diaphragm 44 in contact with the adjacent opposing surface of cap 46 and deformation 72 in axial alignment with hole 52 in cap 46 resulting, for example, from thermal expansion of the lubricant causing a high lubricant pressure differential so that puncture 74 opens at a predetermined differential pressure to permit the flow of lubricant therethrough into the drilling fluid area to prevent damaging differential pressure from occurring and acting against seal 20. Upon a reduction in the differential pressure to a predetermined amount, puncture 74 will self seal to block the flow of lubricant from lubricant reservoir 49.

Thus, in operation, the improved pressure compensating means provides an improved pressure relieving device which functions to provide a relief from excess pressure differentials to which the lubrication system may be exposed thereby tending to equalize the pressures acting on opposed surfaces of seal 20. A puncture in the diaphragm is provided to allow a pressure relief between the lubrication system and the exterior of the drill bit, and also to allow a pressure relief in an opposite direction from the exterior of the drill bit into the lubrication system. Generally a lower pressure relieving point is provided for pressure differentials that are higher within the lubrication system than for pressure differentials that are higher externally of the lubrication system or in the drilling fluid system. For example, lubricant may be relieved at a differential pressure of 75–200 psi while drilling fluids are relieved at a differential pressure of 200–400 psi. The pressure differential at which a pressure relieving device or puncture 74 opens in either direction may be adjusted, for example, such as by changing the thickness of diaphragm 44 at puncture 74, by changing the size of aperture of 54 in cup 42, by changing the shape or size of indentation 72.

Referring now to FIG. 6 in which another embodiment of the invention is shown, diaphragm 44A has a rolling loop 63A and a large thickness central portion 62A. Central portion 62A has a deformation or indentation 72A exposed to lubricant on one side of diaphragm 44A. A separate deformatiion or indentation shown at 78A is formed on the opposite side of diaphragm 44A exposed to drilling fluid. The diameter of indentation 78 is smaller than the diameter of indentation 72A so that puncture 74A opens at a higher pressure differential from drilling fluid than the pressure differential from lubricant. Puncture 74A is formed at the minimum thickness of diaphragm 44A and diaphragm 44A increases progressively in thickness from puncture 74A to the maximum thickness of central portion 62A. The operation of the embodiment shown in FIG. 6 is similar to that of the embodiment shown in FIGS. 1-5.

FIG. 7 is a sectional view of another embodiment of this invention in which a pressure relief device generally indicated at 80 is provided at a location closer to lubricant passage 26B for the bearing areas of the roller cutter than the main diaphragm shown at 44B. Pressure relief device 80 includes a base 88 fitting within a bore in leg 10B and a plug 90 threaded within the bore for gripping a diaphragm 92 between base 88 and plug 90. Diaphragm 92 is exposed to lubricant on one side through port 94 in base 88 and to drilling fluid from port 96 in plug 90. Diaphragm 92 has a center indentation or deformation 72B and a puncture 74B at the center of indentation 72B at the minimal thickness of diaphragm 92. Puncture 74B acts in a manner similar to puncture 74 in the embodiment of FIGS. 1-5. In the event a separate pressure relief device is shown as in FIG. 7, it is not necessary to provide a pressure relief device for the main diaphragm 44B in the lubricant reservoir.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a roller cutter drill bit having a body, a leg extending downwardly from said body with a cylindrical bearing journal on an end thereof, and a roller cutter mounted for rotation on said journal; a lubrication system for providing lubricant to said bearing journal comprising:

a generally cylindrical lubricant reservoir in said leg defining an inner bottom and an open outer end;

a lubricant passage from said reservoir to said bearing journal;

a diaphragm mounted across said reservoir separating said reservoir into a drilling fluid chamber on one side of the diaphragm and a lubricant chamber on the opposite side of said diaphragm;

said diaphragm having an outer periphery, a rolling loop of a relatively small thickness adjacent said outer periphery, and a center portion of a relatively large thickness substantially greater than the thickness of said rolling loop;

said large thickness center portion having a self sealing normally closed puncture, said normally closed puncture opening and relieving a predetermined excess pressure in said lubricant chamber on one side of said diaphragm for leakage of lubricant into said fluid chamber, and opening and relieving a predetermined excess pressure in said drilling fluid chamber on the other side of said diaphragm for leakage of drilling fluid into said lubricant chamber;

a generally bowl shaped rigid cup supported on the bottom of said reservoir and having an aperture at its center; and means on said cup for contacting said reservoir bottom to support said cup thereon and defining fluid passageways between said bottom and said cup to permit fluid flow therethrough.

2. In a roller cutter drill bit as set forth in claim 1 wherein a removable cap covers the open end of said reservoir and secures the outer periphery of said diaphragm about said reservoir.

3. In a roller cutter drill bit as set forth in claim 2 wherein said cap has a central hole therein in fluid communication with an adjacent chamber of said reservoir.

4. In a roller cutter as set forth in claim 3 wherein said cap is adjacent said drilling fluid chamber and said hole in said cap communicates drilling fluid to said drilling fluid chamber for contact with said diaphragm.

5. In a roller cutter drill bit having a body, a leg extending downwardly from said body with a cylindrical bearing journal on an end thereof, and a roller cutter mounted for rotation on said journal; a lubrication system for providing lubricant to said bearing journal comprising:

a generally cylindrical lubricant reservoir in said leg defining an inner bottom and an open outer end;

a lubricant passage from said reservoir to said bering journal;

a diaphragm mounted across said reservoir separating said reservoir into a drilling fluid chamber on one side of the diaphragm and a lubricant chamber on the opposite side of said diaphragm;

a removable cap covering said open outer end of said reservoir and defining with said diaphragm an adjacent chamber of said reservoir;

a counterbore at the open upper end of said reservoir adjacent said cap defining an outer peripheral surface and an adjacent shoulder for forming with said cap an annular pocket diverging radially outwardly; said diaphragm having an annular enlarged cross section about its outer circumference defining a protuberance received within said pocket in contact with said shoulder and said outer peripheral surface, said cap having a diaphragm gripping surface tapering inwardly from said outer peripheral surface and defining a portion of said pocket opposed to said shoulder, said gripping surface upon assembly of said cap pressing against said protuberance to urge said protuberance into sealing contact with said shoulder and said outer peripheral surface thereby to retain said diaphragm within said groove in sealing relation; and a generally bowl shaped cup supported on said inner bottom of said reservoir and having an aperture at its center, said cup terminating at an annular upper end without any outwardly extending flange and supporting said diaphragm upon extension of said diaphragm in a direction toward said cup to provide a flow of fluid through said aperture.

6. In a roller cutter drill bit as set forth in claim 5;

said adjacent shoulder defined by said counterbore tapering inwardly from said outer peripheral surface.

7. In a roller cutter drill bit as set forth in claim 5;

said removable cap having a center hole therein and said adjacent chamber being said drilling fluid chamber with drilling fluid being communicated through said center hole to said drilling fluid chamber.

8. In a roller cutter drill bit as set forth in claim 7;

said diaphragm contacting said cap upon extension of said diaphragm in a direction toward said cap.

9. In a roller cutter drill bit having a body, a leg extending downwardly from said body with a cylindrical bearing journal on an end thereof, and a roller cutter mounted for rotation on said journal; a lubrication system for providing lubricant to said bearing journal comprising:

a generally cylindrical lubricant reservoir in said leg defining an inner bottom and an open outer end;

a lubricant passage from said reservoir to said bearing journal;

a diaphragm mounted across said reservoir separating said reservoir into a drilling fluid chamber on one side of the diaphragm and a lubricant chamber on the opposite side of said diaphragm;

a removable cap covering said open outer end of said reservoir and defining with said diaphragm an adjacent chamber of said reservoir;

a counterbore at the open upper end of said reservoir adjacent said cap defining an outer peripheral surface and an adjacent shoulder for forming with said cap an annular pocket diverging radially outwardly; said diaphragm having an annular enlarged cross section about its outer circumference defining a protuberance received within said pocket in contact with said shoulder and said outer peripheral surface, said cap having a diaphragm gripping surface defining a portion of said pocket opposed to said shoulder, said gripping surface upon assembly of said cap pressing against said protuberance to urge said protuberance into sealing contact with said shoulder and said outer peripheral surface thereby to retain said diaphragm within said groove in sealing relation; and a generally bowl shaped cup supported on said inner bottom of said reservoir and having an aperture at its center, said cup supporting said diaphragm upon extension of said diaphragm in a direction toward said cup to provide a flow of fluid through said aperture;

said cup having a plurality of supporting dimples therein spaced along a circular path about said aperture for contacting said reservoir bottom to support said cup therein, said spaced dimples permitting fluid flow therebetween.

10. A roller cutter as set forth in claim 9;

said cup being mounted in said lubricant chamber and permitting a flow of lubricant through said aperture when drilling fluid pressure exceeds lubricant pressure.

11. In a roller cutter drill bit having a body, a leg extending downwardly from said body with a cylindrical bearing journal on an end thereof, and a roller cutter mounted for rotation on said journal; a lubrication system for providing lubricant to said bearing journal comprising:

a generally cylindrical lubricant reservoir in said leg defining an inner bottom and an open outer end;

a diaphragm mounted across said reservoir adjacent said open end and separating said reservoir into a lubricant chamber on one side of the diaphragm and a drilling fluid chamber on the opposite side of said diaphragm thereby to expose said diaphragm to lubricant on one side thereof and to drilling fluid on the opposite side thereof;

a removable cap covering the open end of said reservoir and having a central hole therein communicating with one of said chambers;

a counterbore at the open upper end of said reservoir adjacent said cap defining an outer peripheral surface and an adjacent shoulder for forming with said cap an annular pocket diverging radially outwardly;

said diaphragm having an annular enlarged cross section about its outer periphery defining a protuberance received within said pocket in contact with said shoulder on one side and in contact with said cap on an opposed side to retain said diaphragm within said pocket in sealing relation, said diaphragm further having a relatively small thickness rolling loop adjacent said outer periphery and a relatively large thickness central portion;

said diaphragm having an indentation exposed to said lubricant chamber at the center of said central portion and a self sealing puncture in said center, the cross section of said indentation increasing progressively in thickness from said puncture to said large thickness central portion; and a generally bowl shaped rigid cup mounted on the bottom of said reservoir and having an aperture at its center, said cup having a plurality of dimples spaced in a circle about and adjacent said aperture therein for contacting the bottom of the reservoir and supporting the cup thereon, said cup supporting said diaphragm upon extension of said diaphragm in a direction toward said cup whereby said puncture and said central hole are in axial alignment;

said puncture in said diaphragm being opened at a predetermined excess differential pressure when said diaphragm is extended against said cup to permit leakage through said puncture and said aligned aperture in said cup, said puncture closing upon a predetermined reduction in said excess differential pressure below said predetermined excess.

* * * * *